United States Patent [19]

Ambrosi et al.

[11] Patent Number: 4,793,259

[45] Date of Patent: Dec. 27, 1988

[54] GRENADE LAUNCHER

[75] Inventors: Francois Ambrosi; Jean-Pascal Guardiola, both of Bourges; Michel Schilling, Chateauneuf/Cher, all of France

[73] Assignee: Luchaire S.A., Paris, France

[21] Appl. No.: 109,402

[22] Filed: Oct. 19, 1987

[30] Foreign Application Priority Data

Oct. 17, 1986 [FR] France ..... 86 14437

[51] Int. Cl.[4] ..... F42B 11/42

[52] U.S. Cl. ..... 102/485; 42/105

[58] Field of Search ..... 102/483, 484, 485; 42/105

[56] References Cited

U.S. PATENT DOCUMENTS

| | | | |
|---|---|---|---|
| 3,664,263 | 5/1972 | Driscoll . | |
| 3,934,513 | 1/1976 | Gabriels | 102/485 |
| 4,013,011 | 3/1977 | Gabriels | 102/485 |

FOREIGN PATENT DOCUMENTS

| | | | |
|---|---|---|---|
| 827664 | 10/1975 | Belgium . | |
| 0171534 | 2/1986 | European Pat. Off. . | |
| 300195 | 6/1919 | Fed. Rep. of Germany . | |
| 1155603 | 5/1958 | France . | |
| 2368686 | 5/1978 | France . | |
| 2517424 | 6/1983 | France | 102/485 |

*Primary Examiner*—Harold J. Tudor

*Attorney, Agent, or Firm*—Robert F. Ziems

[57] ABSTRACT

A rifle grenade comprises, at one end, a tube designed to be fitted to the barrel of a gun and, at the other end, a fuse and a head enclosing an explosive charge, the said tube comprising, upstream of the fuse, a bullet-trap and a booster-charge of propellant powder protected from external influences by a sealed wall.

The said sealed wall is integral with a tubular element of the said tube and comprises an axial cavity defining a reduction in the thickness of the wall sufficient to ensure that the bullet shot by the gun shall pierce the wall without tearing it.

The purpose is to increase the operational safety of rifle grenade.

9 Claims, 3 Drawing Sheets

GRENADE LAUNCHER

The present invention relates to a rifle grenade comprising, at one end, a tube designed to be fitted to the barrel of a gun and, at the other end, a fuse and a head enclosing an explosive charge.

According to known designs, the grenade-tube comprises, upstream of the fuse, a bullet-trap and a booster-charge of propellant powder which may be in the form of loose powder or in the form of a block, the said booster-charge being protected from external influences by a sealing means.

The said sealing means consists of a cup made of a thin sheet of metal such as tin or aluminum or of a plastic material, and capping the end of the booster-charge. The bullet-trap and the booster-charge are held to the inner wall of the tube by a support which may be in the form of a disc or a square plate to which the thin sheet-metal or plastic cup is applied. This disc or plate carries an axial hole, the diameter of which is larger than the calibre of the rifle-bullet.

When the gun is fired, the thin cup is torn by the pressure of the cartridge gases which initiate peripheral ignition of the booster-charge surrounding the bullet-trap.

After the thin metal cup has been destroyed, the bullet passes through the axial hole in the disc or plate and the bullet enters the bullet-trap.

The initial velocity of the bullet is determined, on the one hand, by the energy of the cartridge gases and, on the other hand, by the pressure of the booster-charge combustion-gases.

This known design has several disadvantages.

Most of them are linked to the presence of the sealing device and, in particular, to the fragility of the thin cup and to the shape of the support which permits the retention of water or of impurities which may affect normal combustion of the booster-charge.

On the one hand, this fragility complicates the fitting of the cup and may lead to assembly defects.

On the other hand, because of this fragility, the cup is easily damaged inadvertently during normal handling or intentionally by a saboteur.

In the event of defective assembly of, or damage to, the cup, sealing of the booster-charge is no longer assured. Since the charge is hydrophilic, its combustion may be inhibited by environmental humidity.

The reduction in the range of the rifle grenade, resulting from the inhibition of its booster-charge, makes it inefficient against the enemy and the marksmen may also be endangered.

Furthermore, regular ignition of the booster-charge is strictly dependant upon the mechanical characteristics of the cup, the rupture thereof being governed by cartridge-gas pressure. Thus if the mechanical characteristics of this cup are irregular, ignition of the booster-charge will also be irregular and this correlatively affects the efficiency of the grenade.

Regular ignition of the booster-charge may also be affected by the presence of water or contaminants (mud, sand) in the grenade tube since, upon firing, this water or these contaminants are propelled into the booster-charge combustion-chamber by the cartridges gases and may thus interfere with the combustion of the booster-charge.

It is an object of the invention to overcome the foregoing disadvantages by providing a launching tube which is simpler to use and which functions more reliably than those mentioned hereinbefore.

The rifle grenade according to the invention comprises, at one end, a tube designed to be fitted to the barrel of a gun and, at the other end, a fuse and a head enclosing an explosive charge, the said tube comprising, upstream of the fuse, a bullet-trap and a booster-charge of propellant powder which may be in the form of loose powder or in the form of a block, the said booster-charge being protected from external influences by a sealed wall.

According to the invention, this rifle grenade is characterized in that the sealed wall is integral with a tubular element of the said tube and the said wall comprises an axial cavity defining a reduction in the thickness of the wall sufficient to ensure that the bullet fired by the rifle shall pierce the wall without tearing it.

This sealed wall is preferably made integral with the tube assembly.

The fact that the sealed wall is integral with the tube-element, or with the tube-assembly, greatly simplifies assembly of the grenade rifle, thus eliminating the danger of defective assembly and deterioration of the sealed wall common in known designs.

Moreover, the invention also makes it possible to eliminate the danger of accidental damage to the sealed wall and makes possible sabotage more difficult.

The orifice permitting ignition of the booster-charge by the cartridge gases is made by the bullet, not by the pressure of these gases. This has the following advantages:

more regular ignition of the booster-charge and thus more regular initial velocity of the grenade, thus improving the accuracy thereof;

ignition of the booster-charge is not affected by the presence of water, sand or mud in the grenade tube;

ignition of the booster-charge is possible only after the bullet has been fired, so that it is practically impossible to booby-trap the grenade.

On the other hand, the sealed wall integral with the tube-element or the tube-assembly increases the rigidity of the latter and ensures better confinement of the booster-charge. The thickness of the cylindrical wall of the tube may be reduced, thus lightening the said tube and reducing the cost thereof.

The idea of a sealed wall integral with the tube, and adapted to be traversed by the bullet, may cause one skilled in the art to fear that the wall might burst and that splinters projected rearwardly might injure the marksman.

The person skilled in the art might also fear that the booster-charge could fail to ignite. It might also be feared that the grenade might be propelled forwardly by the firing of the cartridge and that ignition of the booster-charge might be delayed. The fact that ignition of this booster-charge is accomplished in a remarkably regular manner is therefore a triumph over technical prejudice.

According to an advantageous example of embodiment of the invention, the axial cavity provided in the sealed wall is located on the surface of this wall remote from the surface receiving the bullet.

This arrangement makes the cavity more accessible and therefore easier to produce, for example by milling the said wall.

Moreover, with this arrangement, the surface of the sealed wall opposite the cavity remains flat and smooth, thus reducing the likelihood of water, mud or other contaminants being retained.

According to a preferred embodiment of the invention, the cavity provided in the wall has a widened-out section, in the form of an arc of a circle or a triangle, for example. The point of least thickness is thus located on the axis of the tube and the thickness of the wall increases progressively towards the exterior of this axis.

This arrangement makes it possible for the bullet to make, in the wall, a hole which is of regular shape, thus eliminating the danger of uncontrolled bursting of the entire sealed wall.

Other details and advantages of the invention are set forth in the following description.

In the drawings attached hereto, which are given by way of example and are in no way restrictive:

Figure 1:
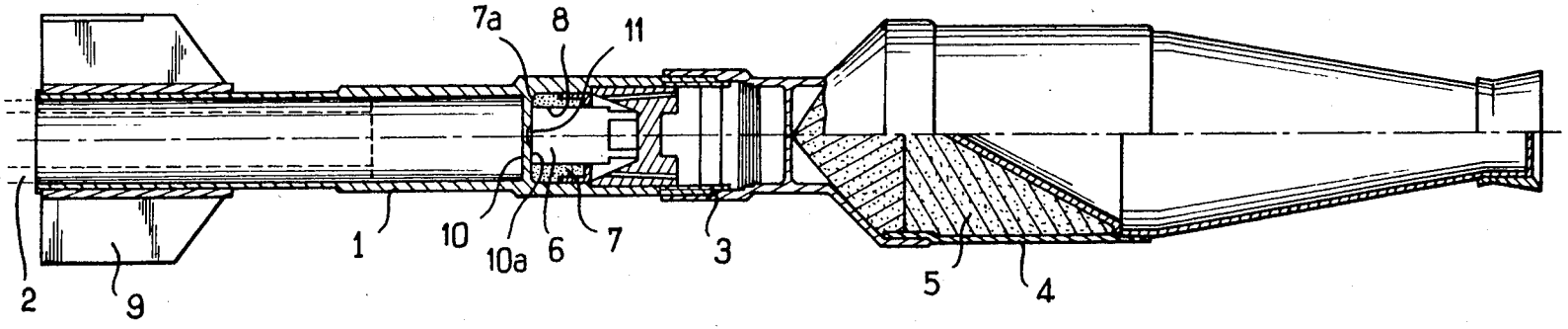
FIG. 1 is a partial longitudinal section through a rifle grenade according to the invention.

In the design according to FIG. 1, the rifle grenade comprises, at one end, a metal tube 1 designed to be fitted to the barrel of a rifle 2 (shown in dotted lines) and, at the other end, a fuse 3 and a head 4 enclosing an explosive charge 5. Tube 1 comprises, upstream of fuse 3 a bullet-trap 6 and a booster-charge 7 of propellant powder in the form of a block exhibiting an axial recess 8. The rear end of tube 1 carries an empennage 9. Fuse 3, head 4, explosive charge 5 and bullet-trap 6 are all elements known per se and therefore need not be described at this time. The same applies to the way in which they are assembled.

Surface 7*a* of block 7 of the booster-charge remote from explosive head 4 (see FIG. 2 also) is separated from the rear end of tube 1 by a sealed wall 10.

According to the invention, sealed wall 10 is integral with the remainder of metal tube 1. Furthermore, wall 10 comprises an axial cavity 11 defining a reduction in the thickness of the wall sufficient to ensure that the bullet fired by the rifle may pierce the said wall without tearing it, as will be explained in detail hereinafter.

In the design illustrated, axial cavity 11 is located in surface 10*a* of wall 10 adjacent block 7 of booster-charge and is therefore remote from the surface receiving the bullet.

Figure 4:
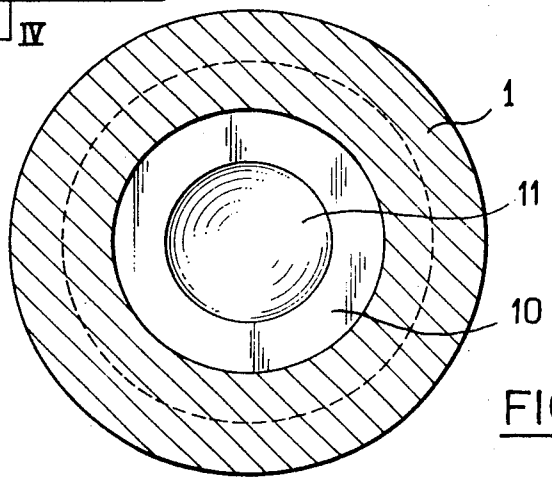
FIG. 4 is a cross-section along the line IV—IV in FIG. 2.
Figure 2:
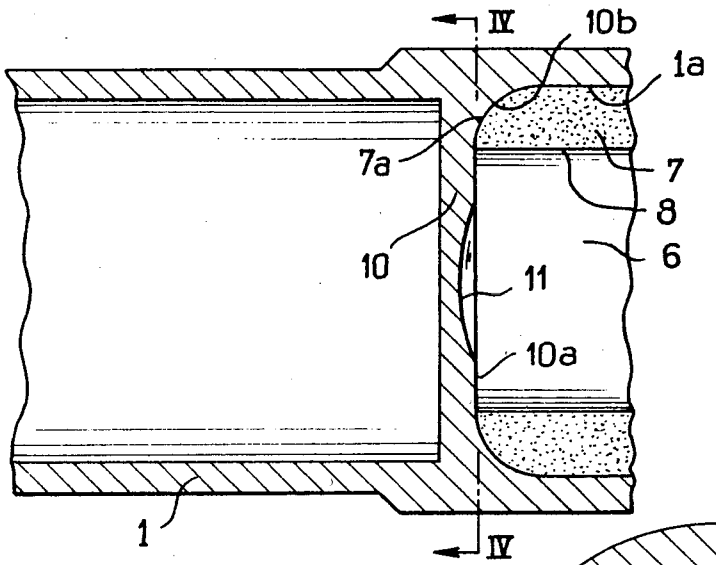
FIG. 2 is a longitudinal section, to an enlarged scale, through the part of the tube comprising the sealed wall.

Cavity 11 has a widened-out section, in the form of an arc of a circle, for example, centred upon the axis of tube 1, as shown in FIG. 2. The said cavity may also be conical. As seen in plan view (FIG. 4), cavity 11 is circular, but it may also be of a non-rotational shape.

Moreover, the diameter of cavity 11 is substantially equal to, or slightly larger than, the calibre of the bullet.

As may also be seen in FIG. 2, surface 10*a* of sealed wall 10 adjacent block 7 of booster-charge is connected to internal surface 1*a* of tube 1 by a fillet 10*b*.

The tube of the rifle grenade according to the invention may easily be manufactured from a moulded or forged metal blank, from a moulded composite plastic material, or from a solid bar of light alloy of sufficient strength. It may also be made as a composite with an insert integral with the wall.

The thickness of wall 10 of tube 1 must be sufficient to withstand the impact of the bullet. In other words, the bullet must be able to pierce the wall opposite to cavity 11, but without tearing it.

Tests have shown that, in the case of a light alloy, a thickness of 1.5 mm makes wall 10 strong enough to withstand the impact of the bullet. This is reinforced by the presence of annular fillet 10b between surface 10*a* adjacent block 7 of booster-charge and tube 1 internal surface 1*a*.

The minimal thickness of wall 10 in the area of cavity 11 is of the eorder of 0.5 mm. The foregoing thicknesses may naturally vary as a function of the type of alloy used.

Wall 10 makes tube 1 more rigid than it is in known designs. This makes it possible to reduce the thickness of the lateral wall of tube 1, thus making it lighter.

Furthermore, since wall 10 is integral with the remainder of tube 1, booster-charge 7, located downstream of this wall, is completely protected from any moisture which may enter tube 1.

Figure 3:
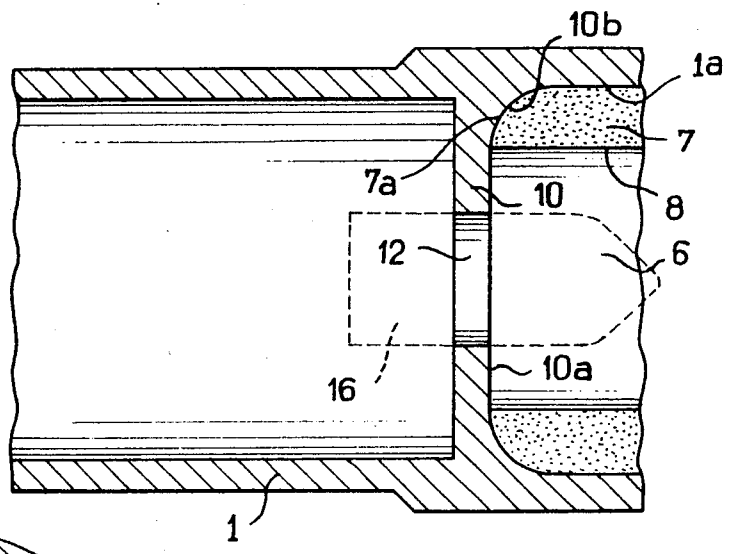
FIG. 3 is a view similar to that in FIG. 2, showing the wall pierced after passage of the bullet.

The rifle grenade described hereinbefore operates as follows:

When bullet 16 is fired, it makes a hole 12 (see FIG. 3) in the zone of reduced thickness adjacent cavity 11, but does not tear the remainder of wall 10. It thus penetrates into bullet-trap 6 and deforms it, thus creating a space between the said bullet-trap and the wall.

After bullet 16 has passed, the propellant gases thereof enter the cavity in block 7 of booster-charge and ignite the charge. The pressure of the resulting combustion gases propels the grenade at a predetermined velocity and arms the fuse.

Since hole 12 is made, not by the pressure of the gases propelling the bullet, but by the bullet itself, there is no danger of these gases forcing moisture or other contaminants, located within tube 1 and retained by the part of wall 10 surrounding hole 12, into the internal cavity in block 7 of booster-charge and thus inhibiting combustion of the said charge.

Moreover, since cavity 11 is adjacent block 7 of booster-charge and is therefore located in a sealed chamber, there is no danger of the said cavity retaining moisture or other contaminants detrimental to the operation of the grenade.

Furthermore, since wall 10 is integral with the remainder of tube 1, there is no danger of this wall being damaged while the grenade is being assembled. The said grenade therefore possesses characteristics of safety and reliability definitely superior to known designs.

Figure 5:
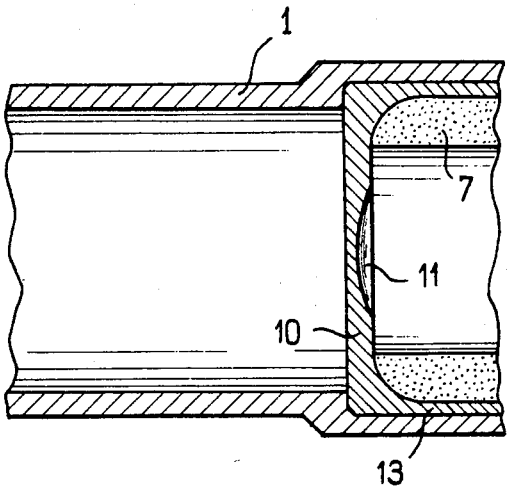
FIGS. 5 to 7 are views, similar to that in FIG. 2, relating to variants.

In the design according to FIG. 5, wall 10 is part of a tubular insert 13 accommodating booster-charge 7. This insert 13 may be made of a material different from that of tube 1, for example a fibre-reinforced composite plastic material. Conversely, the remainder of the tube may be made of a composite plastic material while insert 13 is made of metal.

Figure 6:
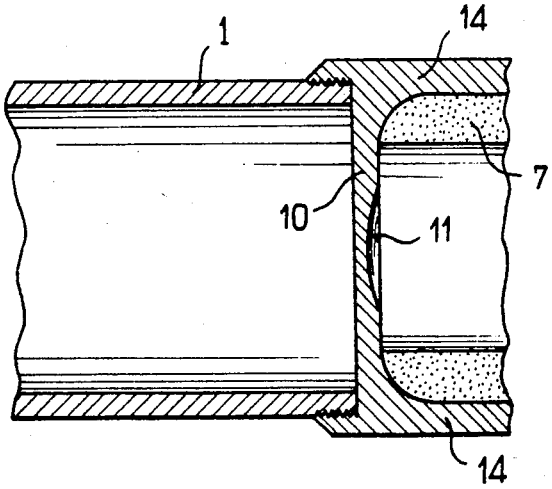

In the design according to FIG. 6, wall 10 is part of a tubular element 14 secured to the remainder of tube 1, for example by screwing.

Figure 7:
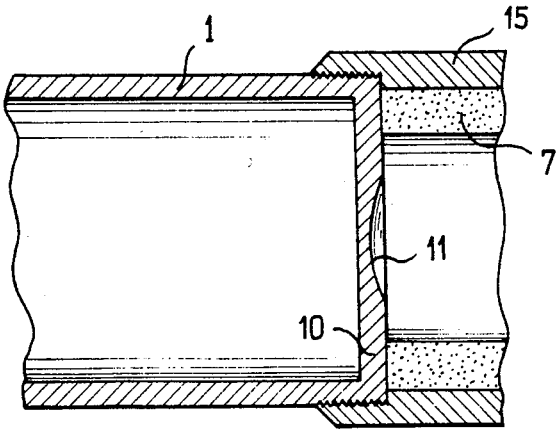

In the design according to FIG. 7, wall 10 is a part of the rear part of tube 1 to which part 15 of the tube, containing booster-charge 7, is secured, for example by screwing.

It is to be understood that the invention is not restricted to the examples described hereinbefore, to which numerous modifications may be applied without departing from the scope of the invention.

For instance, the shape of cavity 11 may differ from that shown, as long as it provides wall 10 with a zone of axial fragility which can be pierced by the bullet without tearing the remainder of the wall.

It is to be understood that the given dimensions may vary according to the application contemplated.

We claim:

1. A rifle grenade comprising at one end, a launching tube designed to be fitted onto the barrel of a rifle and, at the other end, a fuse and a head enclosing an explosive charge, said tube comprising, upstream of the fuse, a bullet-trap and a booster-charge of propellant powder protected from external influences by a transverse one-piece sealing wall, characterized in that the sealing wall is integral with an axially extending wall portion of the said tube and comprises an axial cavity defining a reduction in the thickness of the wall sufficient to ensure that the bullet shot by the rifle shall penetrate the wall while maintaining the integrity of the wall about the bullet.

2. A rifle grenade according to claim 1, characterized in that the wall is integral with the tube.

3. A rifle grenade according to claim 1, characterized in that the axial cavity is provided in a surface of the wall located on the downstream side of the wall in terms of the bullet trajectory.

4. A rifle grenade according to claim 1, characterized in that the cavity is divergent in the direction of the bullet trajectory.

5. A rifle grenade according to claim 1, characterized in that the cavity is circular.

6. A rifle grenade according to claim 5, characterized in that the diameter of the cavity of substantially equal to, or slightly larger than the calibre of the bullet.

7. A rifle grenade according to claim 1, characterized in that said sealing wall is joined with said axially extending wall portion of said tube by a fillet located on the downstream side of the wall in terms of bullet trajectory.

8. A rifle grenade according to claim 1, wherein said sealing wall, said axially extending wall portion and the remainder of said tubes are made from metal or metal alloy.

9. A rifle grenade according to claim 1, wherein said sealing wall and said axially extending wall portion is made from metal or metal alloy whereas the remainder of said tube is made from composite or plastic materials.

* * * * *